United States Patent [19]

Levy

[11] 3,952,702

[45] Apr. 27, 1976

[54] ELECTROPHOTOGRAPHIC LIQUID TONER DEVELOPMENT APPARATUS

[75] Inventor: Raymond L. Levy, Palo Alto, Calif.

[73] Assignee: Varian Associates, Palo Alto, Calif.

[22] Filed: Dec. 9, 1974

[21] Appl. No.: 530,783

Related U.S. Application Data

[63] Continuation of Ser. No. 127,683, March 24, 1971, abandoned.

[52] U.S. Cl. ..... 118/637; 118/DIG. 23; 355/10; 427/17

[51] Int. Cl.[2] ..... G03G 15/10

[58] Field of Search ..... 118/637, DIG. 23; 427/17, 15; 96/1 LY; 355/3 P, 10, 16

[56] References Cited

UNITED STATES PATENTS

| | | | |
|---|---|---|---|
| 3,305,459 | 2/1967 | Smith et al. | 118/637 |
| 3,367,791 | 2/1968 | Lein | 118/DIG. 23 |
| 3,502,408 | 3/1970 | Brodie | 355/16 |
| 3,618,567 | 11/1971 | Levy | 427/15 |
| 3,627,410 | 12/1971 | Jugle | 355/10 |
| 3,635,195 | 1/1972 | Levy | 427/15 |
| 3,672,326 | 6/1972 | Schulze | 118/DIG. 23 |
| 3,673,985 | 7/1972 | Dols | 118/DIG. 23 |

OTHER PUBLICATIONS

IBM Technical Disclosure; Vol. 8, No. 4, Sept. 1965, Crawford, T. M., Developing Electrostatic Charge Patterns.

*Primary Examiner*—Mervin Stein
*Assistant Examiner*—Douglas Salser
*Attorney, Agent, or Firm*—S. C. Cole; D. R. Pressman; P. M. Hentzel

[57] ABSTRACT

The charge image bearing surface of a web to be developed is partially wrapped around the periphery of a perforated rotatable drum-shaped development electrode. Liquid electrographic toner is forced through the perforated drum against the charge image bearing surface of the recording web for developing the electrostatic image thereon. The drum is rotated to provide a peripheral velocity substantially different than the velocity of the web being developed such as to produce a sliding action between the periphery of the drum and the web. In this manner, the relatively stationary boundary layer of depleted liquid toner carried by the web is disturbed such that the pigment particle depleted layer of toner is replenished by toner forced through the perforated development electrode.

6 Claims, 2 Drawing Figures

ELECTROPHOTOGRAPHIC LIQUID TONER DEVELOPMENT APPARATUS

This is a continuation of application Ser. No. 127,683 filed Mar. 24, 1971, now abandoned.

DESCRIPTION OF THE PRIOR ART

Heretofore, a drum shaped development electrode carried electrographic toner from a reservoir to a charge image bearing surface of a recording web for development of the charge image. The drum was rotated with an angular velocity such that the periphery of the drum had a velocity substantially greater than the velocity of the web such that a build-up of toner occurred between the web and the rotating development drum. In addition, the motion of the drum provided a hydro-dynamic force for pushing the web away from the drum and against a backing electrode to assure a predetermined spacing between the drum shaped development electrode and the charge image on the web to be developed. Such a development apparatus is disclosed in U.S. Pat. No. 3,367,791 issued Feb. 6, 1968.

In another prior art development apparatus for developing electrostatic images, a porous drum-shaped development electrode was rotated in synchronism with the velocity of the web to be developed which was partially wrapped over the surface of the drum. Liquid electrographic toner was forced through the perforated drum against the electrostatic charge images for development thereof. Such a development electrode arrangement is disclosed in co-pending U.S. application Ser. No. 858,044 filed Sept. 15, 1969, now Pat. No. 3,618,567, granted 9 Nov. 1971, and assigned to the same assignee as the present invention. While this latter development apparatus is entirely suitable for developing electrostatic charge image patterns at relative low web velocity, it is desired to obtain a development electrode structure which will provide adequate toning of the images at faster velocities of the copy being developed.

SUMMARY OF THE PRESENT INVENTION

The principal object of the present invention is the provision of improved method and apparatus for developing charge images.

In one feature of the present invention, electrographic toner is forced through a perforated development electrode against the image bearing surface to be developed. Substantial slippage is obtained between the development electrode and the adjacent surface of the charge bearing member such that a fluid shearing action is produced at the interface of the development electrode and the surface being developed to disturb the boundary layer of development fluid carried by the charge bearing member and to provide replenishment of the toner depleted from such boundary layer.

In another feature of the present invention a development electrode comprises a rotatable perforated hollow cylindrical member having means therein for forcing the electrographic toner through the perforated cylinder. The cylindrical development electrode is rotated about its axis of rotation with a peripheral velocity substantially different than the velocity of the adjacent charge image bearing surface being developed to produce a fluid shearing action therebetween for scrubbing the boundary layer of development fluid adjacent the image bearing surface of the web.

In another feature of the present invention, a perforated development electrode, through which the electrographic toner is forced into contact with the charge image bearing surface, comprises a sheet metal member perforated with an array of holes of generally uniform diameter such holes being generally larger in diameter than the thickness of the sheet. The electrode is perforated to have a transparency, due to the perforations, in excess of 20%, whereby copious amounts of toner are readily forced through the development electrode against the charge bearing web.

In another feature of the present invention, first and second development stations are provided in tandem with the image bearing surface to be developed. Each of the development stations includes a perforated development electrode moved with a differential velocity relative to the charge image bearing surface to be developed. A squeegee is disposed intermediate the tandem stations for removing the boundary layer of toner from the charge image surface being developed.

Other features and advantages of the present invention will become apparent upon a perusal of the following specification taken in connection with the accompanying drawings, wherein:

DESCRIPTION OF THE PREFERRED EMBODIMENTS

Figure 1:
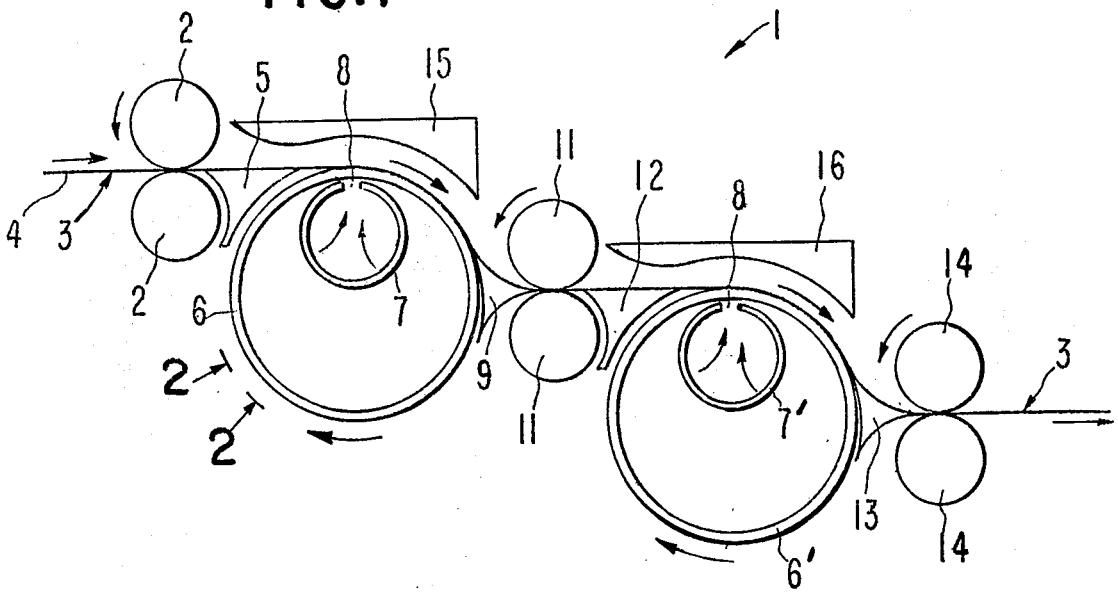
FIG. 1 is a schematic longitudinal sectional view of an electrographic developing apparatus employing features of the present invention.

Referring now to FIG. 1, there is shown an electrographic development apparatus incorporating features of the present invention. The development apparatus 1 includes a pair of feed rollers 2, as of rubber and polished stainless steel for the upper and lower rollers, respectively, to receive therebetween an electrographic recording web 3, such as dielectric coated conductive paper, having a charge retentive surface layer 4 thereon containing a charge image to be developed. The charge image is on the side of the web 3 facing downwardly as the web 3 enters the feed rollers 2.

Figure 2:
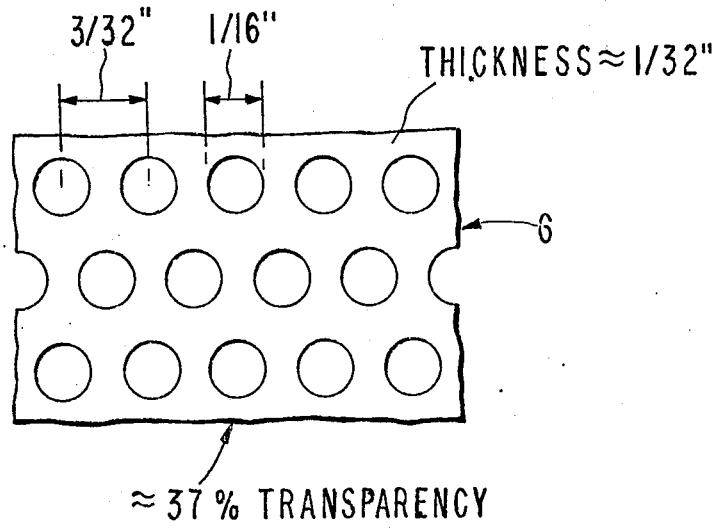
FIG. 2 is an enlarged sectional view of a portion of the structure of FIG. 1 taken along line 2—2 in the direction of the arrows.

The feed rollers 2 feed the electrographic recording web 3 over a paper guide 5 and around the outer periphery of a perforated drum-shaped development electrode 6. The development drum 6 includes a hollow cylindrical sheet metal member, more clearly shown in FIG. 2. More particularly, a sheet metal member 6, i.e. stainless steel as of 0.028 inches in thickness, is perforated with a diagonal pattern of holes, as of 0.063 inches in diameter, having center line spacings, as of 0.096 inches, such that the drum has a transparency of approximately 37%.

A toner feed channel 7 is disposed inside the drum 6 in a stationary position near top dead center of the drum 6. A feed slot 8 is provided longitudinally of the cylindrical channel 7 adjacent the top dead center position of the rotatable drum 6.

Electrographic liquid toner, under relatively low pressure, is fed through the feed channel 7 and slot 8 against the inside surface of the perforated drum 6. In this manner, liquid electrographic toner is forced through the perforations of the drum 6 against the charge bearing surface of the electrographic recording web 3 for developing the charge image patterns on the web 3. Toner returns by gravity to a sump, not shown, from which it is circulated by a pressure pump.

A drive mechanism, such as a toothed belt, interconnects both cylindrical feed rollers 2 and the hollow cylindrical development drum 6 in such a manner as to drive the drum 6 with an angular velocity such that the peripheral velocity of the drum 6 is substantially different than the corresponding velocity of the electrographic recording web 3. More particularly, in one example, the electrographic recording web 3 is driven via feed rollers 2 at a velocity of approximately 2.5 inches per second, whereas the drum 6 is rotationally driven about its longitudinal axis with an angular velocity such that the peripheral velocity of the drum is approximately 25 inches per second. In other words, the velocity of the drum is approximately 10 times the velocity of the recording web 3. In a preferred embodiment, the drum 6 rotates in the same direction as the web.

The differential velocity between the periphery of the development drum 6 and the electrographic recording web 3 serves to produce a substantial slippage and fluid shearing action between the web 3 and the periphery of the drum 6. This fluid shearing motion serves to substantially disturb the relatively static boundary layer of dielectric fluid toner carried adjacent the surface of the electrographic recording web 3. By producing the shearing motion and disturbance of the boundary layer, the electroscopic pigment particles forced against the web 3 from within the development drum 6 serve to replenish the toner particles depleted from the boundary layer. In this manner, much faster development of the electrostatic charge images is obtained because the toner is continuously replenished to the layer of fluid immediately adjacent the charge image on the web 3. This fluid scrubbing action, which tends to disrupt the boundary layer of fluid against the charge image, greatly improves the toning efficiency or development efficiency of the development apparatus 1.

The electrographic recording web 3 is wrapped partially around the periphery of the drum 6 and is picked off the drum 6 via pick off fingers 9 and directed through a second pair of interstage cylindrical squeegee rollers 11, of the same configuration as rollers 2, which are also geared to and driven with the input rollers 2, to squeegee depleted development liquid from the web 3 and to feed the web over a second paper guide 12 and around a second perforated drum-shaped development electrode 6′ of a second development station which is substantially identical to the first mentioned development station.

The web 3 is picked off the second development drum 6′ via a pick off 13 and fed through a third pair of squeegee rollers 14 driven in synchronism with the first and second pair of rollers 2 and 11, respectively, to deliver a fully developed and dry electrographic charge image on the underside of the electrographic web as it emerges from the third set of squeegee rollers 14. Paper deflectors 15 and 16 are disposed over the first and second development drums 6 to guide the electrographic recording web 3 through the development apparatus 1.

The development apparatus of FIG. 1 will provide relatively large area development of an electrographic recording web 3 traveling at a relatively high velocity, as of 20 inches to 30 inches per second. The tandem stages of development provide full development of the electrographic charge image. The tandem stages are in the preferred embodiment, stepped downward as shown sufficiently that the leading edge of copy web 3 is never forced to an upward incline, thereby keeping liquid from flowing on the back of the copy. As many stations as required may be added, each contributing to additional toning density. This system is designed to keep the back of the copy web as dry as possible, thus carrying the least amount of toner from the system.

In each development station, the toning channel feeds approximately ¼ of a gallon per minute of electrographic liquid toner through the perforated development electrode against the charge image bearing surface of the recording web 3. The development electrode drums may be operated at a floating potential or may be supplied with a potential relative to a potential applied to then conductive paper deflectors 15 and 16. These paper deflectors may have their spacing from the development electrode 6 varied for optimum performance.

In this latter case, an electrical bias potential is applied between the deflectors 15 and 16 and the respective development electrode. This bias potential may be varied or selected, as desired, to enhance toning or to suppress undesired background development of the electrostatic images on the electrographic recording web 3.

While the above disclosure contains many specificities, these should not be construed as limitations upon the scope of the invention but merely as an examplification of several preferred embodiments thereof. The true scope of the invention is indicated by the appended claims and their legal equivalents.

What is claimed is:

1. Apparatus for developing a charge image on the surface of a flexible recording medium through the use of a dielectric development fluid comprising, in cooperative combination:

a. a perforated development electrode having an upwardly-facing surface, b. means for positioning a charge image bearing surface of a recording medium above and facing downwardly so as to be in physical contact with said upwardly-facing surface of said development electrode such that the portion of said recording medium in physical contact with said development electrode conforms directly to the configuration of the portion of said development electrode with which it is in contact, said means for positioning being free of the surface of said recording medium opposite said charge image bearing surface thereof over the portion of said recording medium adjacent said development electrode so that in absence of said recording medium, said means will not become wet by flow of said dielectric development fluid whereby said opposite surface of said recording medium will always remain dry, even if continuity thereof is interrupted, c. means for continuously causing said dielectric development fluid to flow upwardly through the perforations in said development electrode and against said charge image bearing surface of said recording medium, when present, so as to tend to form a fluid boundary layer on said recording medium, said development electrode, said recording medium, and said means for positioning all positioned to be free of said fluid in absence of said dielectric development fluid flow, and d. means for causing relative motion between said development electrode and said recording medium so as to cause the surface of said development electrode to remove continuously and substantially and replenish said boundary layer of said dielectric development fluid from between said development electrode and said recording medium.

2. The apparatus of claim 1 wherein said perforated development electrode is a rotatable hollow cylinder and further including means for rotating said cylinder and means for moving said recording medium to have a linear velocity less than the peripheral velocity of said cylinder so as to establish a fluid shearing action which substantially removes said boundary layer of development fluid, and further including means for causing said development fluid to flow from inside said cylinder through the perforations therein and against said recording medium.

3. The apparatus of claim 2 wherein said means for positioning comprises guide means for wrapping said recording medium about a portion of said hollow cylinder so as to establish an area of contact between said medium and said cylinder.

4. The apparatus of claim 3 wherein said hollow cylinder is a sheet member having an array of spaced perforations generally larger in diameter than the thickness of said sheet member, said sheet member having a transparency of greater than 20%, thereby to enable a copious flow of development fluid through said spaced perforations and against said recording medium.

5. The apparatus of claim 2 wherein a plurality of hollow cylinders are provided in series for sequentially developing the charge images on said recording medium.

6. The apparatus of claim 5 wherein said means for positioning comprises guide means for wrapping said recording medium around a portion of each of said hollow cylinders during developing, said plurality of cylinders being mounted in progressively lower positions so as to prevent an upward incline at any portion of said recording medium during development thereof, thereby preventing the development fluid from flowing onto the reverse side of said recording medium.

* * * * *